US005979138A

United States Patent [19]

Allen

[11] Patent Number: 5,979,138

[45] Date of Patent: Nov. 9, 1999

[54] ADJUSTABLE CONCRETE FORMS

[76] Inventor: Timothy R. Allen, 6743 Hickory Ridge Rd, Holly, Mich. 48442

[21] Appl. No.: 08/990,017

[22] Filed: Dec. 12, 1997

[51] Int. Cl.[6] ..... E04G 21/00; E04G 11/06

[52] U.S. Cl. ..... 52/745.09; 249/47; 249/192

[58] Field of Search ..... 249/192, 196, 249/44, 47; 52/745.09, 745.05, 585.1

[56] References Cited

U.S. PATENT DOCUMENTS

| | | | |
|---|---|---|---|
| 850,667 | 4/1907 | Mitchell | 249/196 |
| 3,246,871 | 4/1994 | Bowden . | |
| 3,385,555 | 5/1968 | Williams . | |
| 3,862,737 | 1/1975 | Fuston, Jr. | 249/47 |
| 4,030,694 | 6/1977 | Schimmel | 249/196 |
| 4,185,805 | 1/1980 | Ewing . | |
| 4,194,717 | 3/1980 | Easton et al. | 249/196 |
| 4,975,099 | 12/1990 | Easton et al. | 249/192 |
| 5,251,868 | 10/1993 | Trimmer et al. | 249/196 |
| 5,509,635 | 4/1996 | Jaruzel . | |

*Primary Examiner*—Michael Safavi
*Attorney, Agent, or Firm*—Harness, Dickey & Pierce, P.L.C.

[57] ABSTRACT

An adjustable form, for use in casting cementitious material on a preformed footing structure. The form having a frame, a pair of parallel-spaced vertical sidewalls, and at least one vertically disposed oblong aperture within one sidewall. The vertically disposed oblong aperture allows for placement of a connecting pin through the oblong aperture so as to connect one form with respect to a second form offset relative to the second form. Thus, accommodating variations in the preformed footing with one form being.

3 Claims, 3 Drawing Sheets

ADJUSTABLE CONCRETE FORMS

BACKGROUND OF THE INVENTION

1. Field of the Invention

The present invention relates to adjustable concrete forms for use in casting concrete and, more particularly, to adjustable concrete forms having at least one oblong aperture extending vertically to facilitate the vertical adjustment of a concrete form relative to another concrete form.

2. Background and Summary of the Invention

In construction, the use of concrete as a support material is well known. In fact, concrete is employed in various residential and commercial applications to construct support structures, such as foundations, walls, and the like. To this end, concrete forms are commonly used to encapsulate a volume having an open top portion into which liquid concrete is poured and cured.

Concrete forms are traditionally held together by either a rod and cotter pin assembly or by clamps. These fastening means are typically separate from the concrete forms and, thus, increase the difficulty in assembling a plurality of concrete forms.

Further, conventional concrete forms which are held together by rod and cotter pins include round apertures along the sidewall of the panel for inserting the rod therethrough. However, this design increases the difficulty in assembling the panels since it does not allow for adjustment in the vertical direction. Vertical adjustment is preferable because the preformed footing or ground surface upon which the concrete structure is formed may not be level. As such, the round apertures in one panel are incorrectly positioned relative to an adjacent panel, and in turn increases the time and effort required to assemble the concrete forms, since time must be taken to level the foundation upon which the concrete forms come to rest.

It is therefore desirable to provide an improved concrete form which allows for vertical adjustment with respect to an adjacent form so as to accommodate variations in the footing or ground surface upon which the concrete is to be formed. It is also desirable to provide an improved concrete form having a selectively adjustable connecting member, permanently attached to the framework of the form to facilitate quick and convenient methods of assembly.

According to the preferred embodiment of the present invention, a concrete form is provided having a frame including a pair of parallel-spaced vertical sidewalls, and a panel attached to the frame wherein at least one of the side walls includes at least one vertically disposed oblong aperture which allows the form to be quickly and conveniently adjusted to accommodate variations in the footing or other ground surface upon which the concrete structure is to be formed.

Additionally, a preferred embodiment employs a selectively adjustable connecting member permanently attached to the frame of the concrete form which includes an elongated slot for receiving a wedge therein. Using this method, the connecting member or pin is quickly and conveniently inserted through the oblong, vertically disposed aperture of an adjacent panel to fasten the two adjacent panels together. The wedge itself provides an improvement over the art in that as the wedge is inserted through the slot in the pin, the panels are forced together.

Further areas of applicability of the present invention will become apparent from the detailed description provided hereinafter. It should be understood however that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment is merely exemplary in nature and is in no way intended to limit the invention, its application, or uses.

Figure 1:
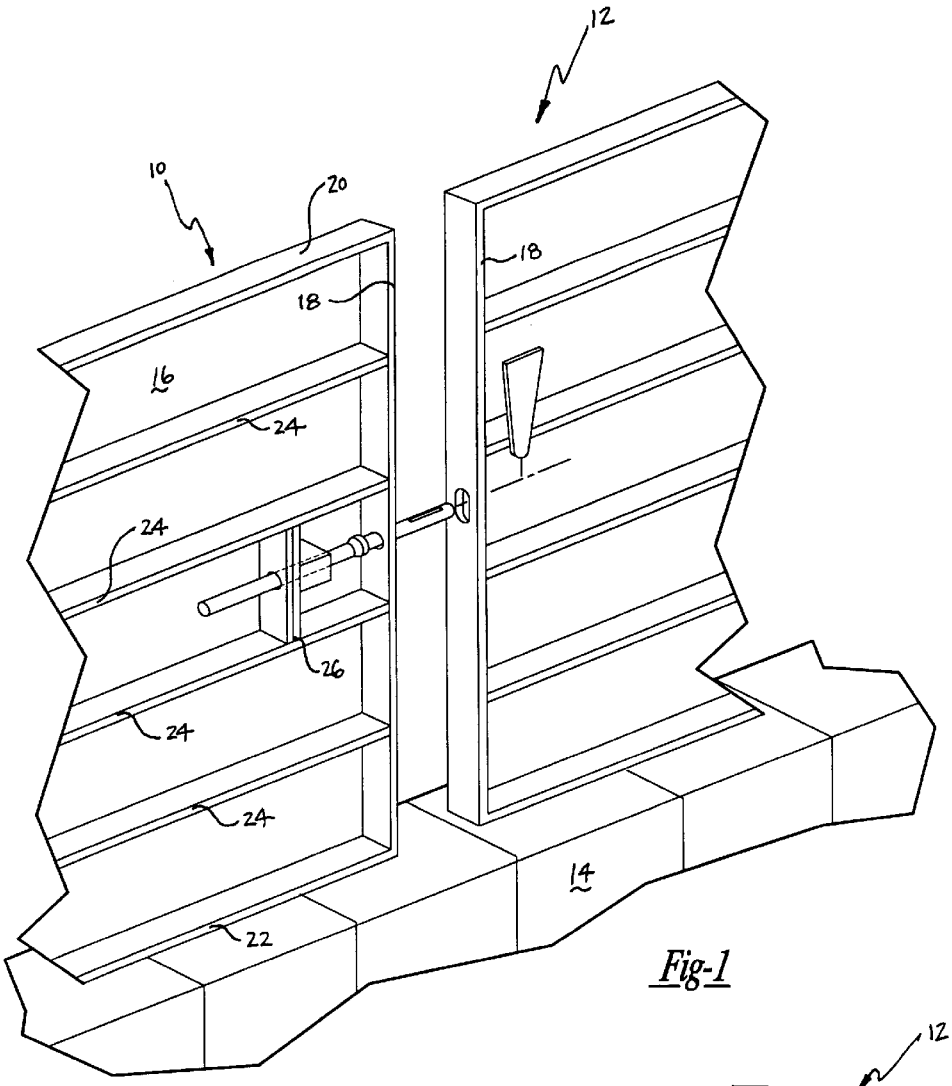
FIG. 1 is a perspective view of a pair of adjustable concrete forms according to the present invention positioned upon a preformed footing.

Referring to the drawings, FIG. 1 illustrates a perspective view of a pair of adjustable concrete forms 10, 12 according to the present invention positioned upon a preformed footing 14. Adjustable concrete forms 10, 12 are identical to each other in construction and operation. Accordingly, for clarity of disclosure the invention will generally be described with reference to a single concrete form 10.

Adjustable concrete form 10 comprises a frame 16 including a pair of substantially parallel vertically extending sidewalls 18. Adjustable concrete form 10 further includes a top wall 20, a bottom wall 22, a plurality of horizontal support members 24 extending between the sidewalls, and a vertical support member 26 connected to two of the horizontal support members. As will be described in greater detail below, a connecting device 28 is fixed to vertical support member 26. Disposed along one side of the frame 16 is a panel 48 against which the concrete is poured and allowed to cure.

Without intending to be limited by way of example, concrete forms having widths ranging from 1" to 36" have been found to provide sufficient flexibility in design and assembly of concrete form structures. It is anticipated, however, that concrete form 10 may be of any length that can be easily and conveniently handled and assembled.

Figure 2:
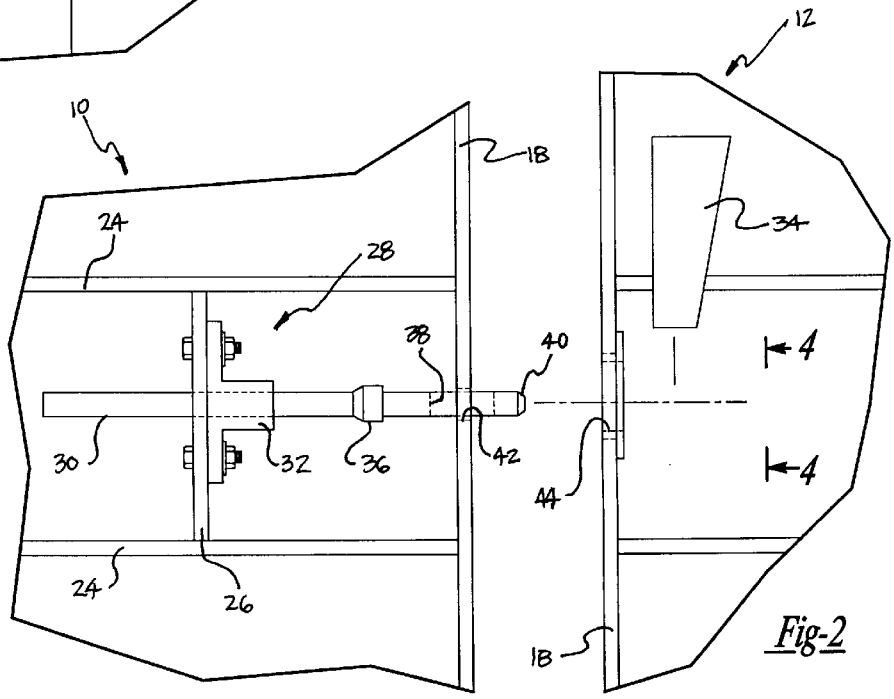
FIG. 2 is a partial front view of the adjustable concrete form shown in FIG. 1 illustrating the connecting member in a disengaged position.
Figure 3:
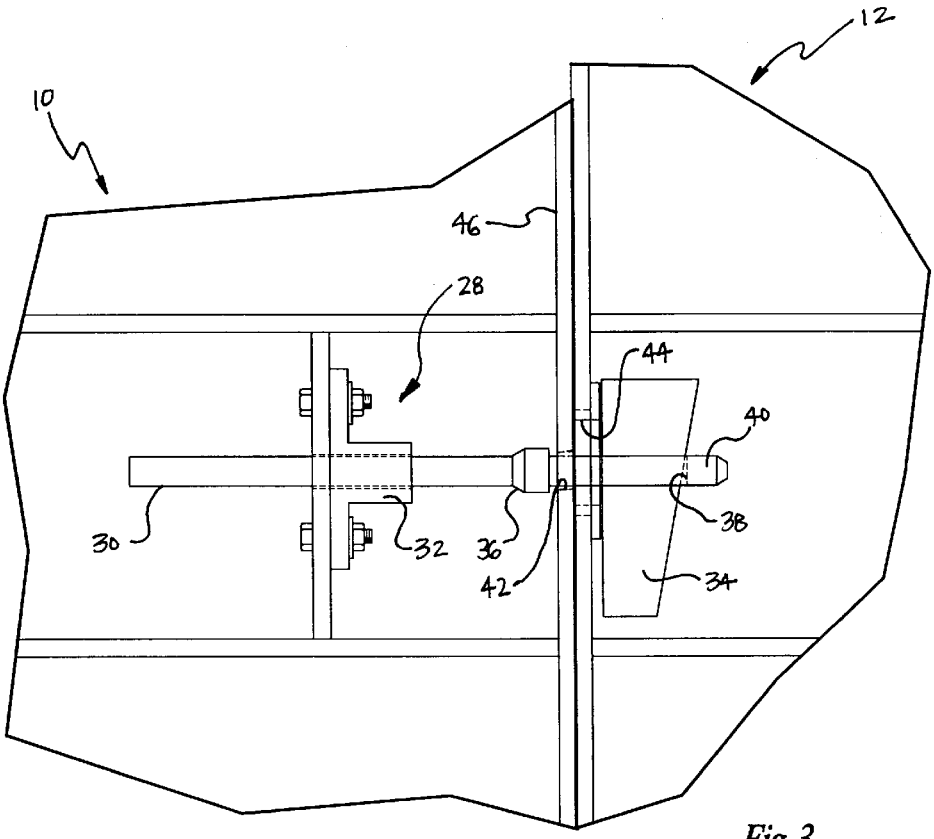
FIG. 3 is a partial front view of the adjustable concrete form shown in FIG. 1 illustrating the connecting member in an engaged position.

As best seen in FIG. 2, connecting device 28 includes a connecting pin 30, a pin guide 32, and a wedge 34. The connecting pin 30 preferably includes a flange 36 and an elongated slot 38 (shown hidden) for receiving wedge 34. In operation as seen in FIG. 3, adjustable concrete form 10 is positioned adjacent adjustable concrete form 12 such that sidewall 18 of concrete form 10 is in close proximity to sidewall 18 of concrete form 12. A tip portion 40 of connecting pin 30 is extended through a first sized aperture 42 of sidewall 18 of concrete form 10 and further through a vertically disposed oblong aperture 44 until flange 36 contacts an inner surface 46 of sidewall 18 of concrete form 10. Wedge 34 is then inserted into the elongated slot 38 of connecting pin 30 so as to couple concrete forms 10 and 12 together. Using a plurality of concrete forms 10, 12 allows a volume to be encapsulated into which concrete may be poured and cured.

Although the details are not clearly illustrated in the figures, the connecting device 28 may include a ratcheting system capable of manually, pneumatically or hydraulically, coupling concrete forms 10 and 12 together. As the connecting pin is advanced through the apertures 42 and 44, respectively, the pin is locked in place by the racheting system.

Figure 4:
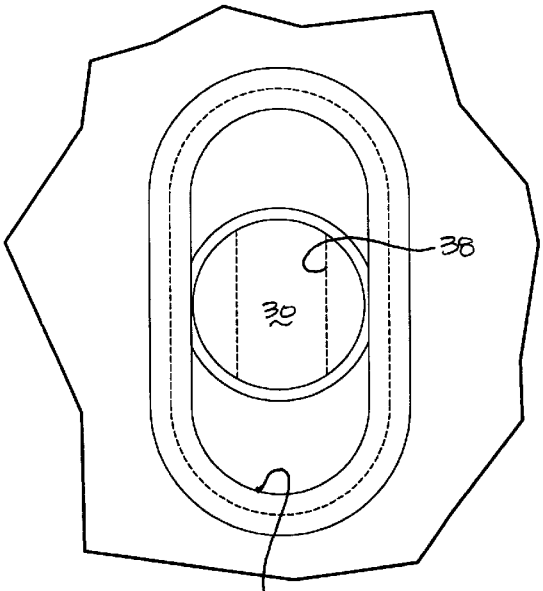
FIG. 4 is a partial side view of the connecting member shown in FIG. 2.
Figure 7:
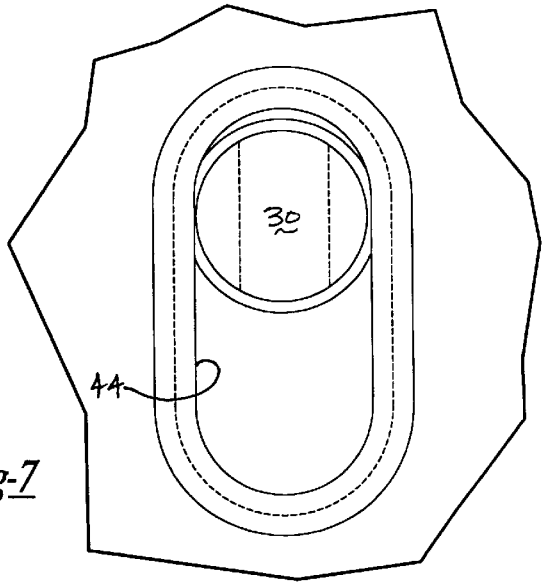
FIG. 7 is a partial side view of the connecting member shown in FIG. 6.
Figure 5:
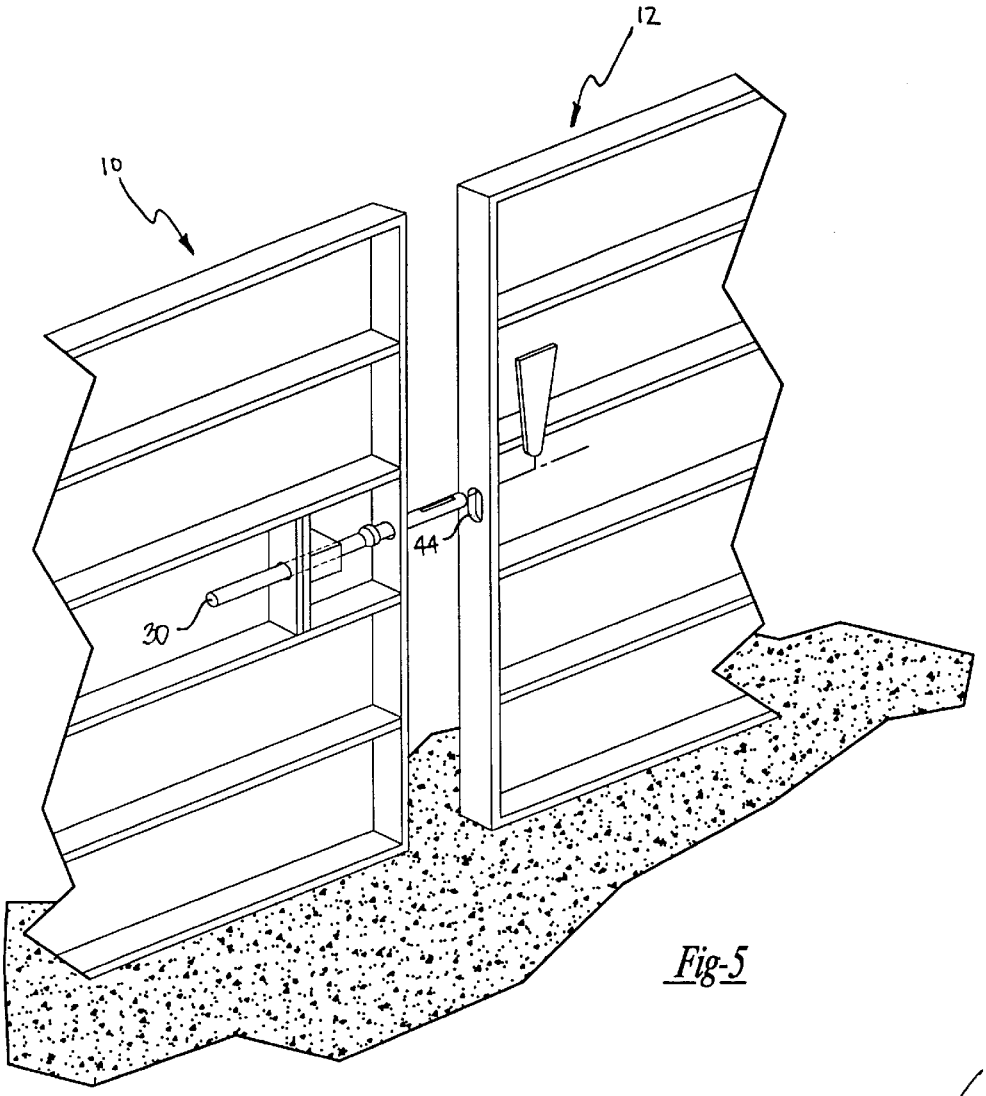
FIG. 5 is a perspective view of a pair of adjustable concrete forms disposed upon a prepared ground surface.
Figure 6:
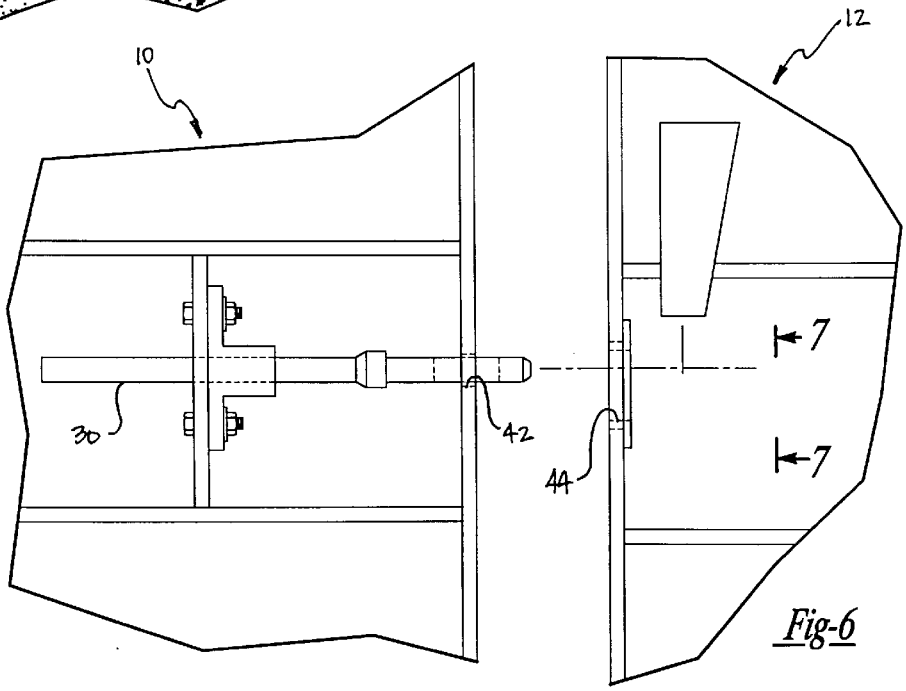
FIG. 6 is a partial front view of the adjustable concrete form, similar to FIG. 2, illustrating the connecting member adjusted in the vertical direction.

The method of assembly as described above allows for vertical adjustment of concrete form 10 with respect to form 12 to accommodate variations in preformed footing 14 or other ground surface upon which the concrete structure is to be formed. Specifically, the present invention allows connecting pin 30 to extend through the vertically disposed oblong aperture 44 substantially irrespective of the placement of concrete form 10 relative to form 12. For example, if preformed footing 14 is level, connecting pin 30 will generally extend through the center of oblong aperture 44, as seen in FIG. 4. However, if preformed footing 14 is out of level, connecting pin 30 though still sufficiently extending through the oblong aperture, will be offset relative to the center of oblong aperture 44, as seen in FIGS. 5–7.

Without intending to be limited by example, the vertically disposed oblong aperture generally has an overall length of approximately 1¼" and a width of approximately ¾" both of which have been found to be adequate. Furthermore, the oblong aperture may be of any shape conducive to vertical adjustment, such as a continuous oval aperture as shown in FIGS. 4 and 7 or may be rectangular with the longer sides extending vertically.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of assembling a plurality of adjustable forms upon a substrate said substrate having elevational variations, said method comprising:

providing a first and a second adjustable form, each of said forms having a frame including a pair of parallel-spaced vertically disposed sidewalls, at least one of said sidewalls having at least one vertically disposed oblong aperture contained therein for accommodating elevational variations along the substrate, a panel disposed along one side of said sidewalls, and at least one selectively adjustable connecting member dimensioned to extend through said at least one vertically disposed oblong aperture;

positioning said first and second form upon the sudstrate such that said at least one connecting member of said first form as vertically offset relative to said vertically disposed oblong aperture of said second form in response to the elevational variations in the substrate;

extending said at least one connecting member of said first form through said at least one vertically disposed oblong aperture of said second form while said first form is vertically offset relative to said second form; and engaging a retaining device with said connecting member of said first form.

2. The method of assembly according to claim 1 wherein said at least one connecting member includes a pin structure having an elongated slot.

3. The method of assembly according to claim 2 wherein said retaining divice includes a selectively detachable wedge for insertion into said slot.

* * * * *